US008312589B1

(12) United States Patent
Thomas

(10) Patent No.: US 8,312,589 B1
(45) Date of Patent: Nov. 20, 2012

(54) PUSH AND PULL SHOCK ABSORBING SCRAPER

(76) Inventor: Paul B. Thomas, San Pedro, CA (US)

( * ) Notice: Subject to any disclaimer, the term of this patent is extended or adjusted under 35 U.S.C. 154(b) by 996 days.

(21) Appl. No.: 12/317,747

(22) Filed: Dec. 29, 2008

Related U.S. Application Data

(63) Continuation-in-part of application No. 10/881,770, filed on Jun. 30, 2004, now Pat. No. 7,469,444.

(51) Int. Cl.
*A47L 13/12* (2006.01)

(52) U.S. Cl. ..... 15/236.02; 15/236.08; 15/236.01

(58) Field of Classification Search ..... 15/236.02, 15/236.08, 236.01, 172, 111, 117, 144, 1, 15/113
See application file for complete search history.

(56) References Cited

U.S. PATENT DOCUMENTS

| | | | | |
|---|---|---|---|---|
| 4,305,175 | A | 12/1981 | Burgess, Jr. | |
| 4,748,711 | A * | 6/1988 | Markus | 15/227 |
| 4,813,458 | A | 3/1989 | Jacobucci | |
| 4,962,561 | A | 10/1990 | Hamilton | |
| 4,984,324 | A | 1/1991 | Farris | |
| 5,208,984 | A * | 5/1993 | Negus | 30/169 |
| 5,455,981 | A | 10/1995 | Wiese | |
| 5,471,698 | A | 12/1995 | Francis et al. | |
| 5,897,119 | A | 4/1999 | McMillen | |
| 6,640,943 | B1 | 11/2003 | Daws et al. | |
| 6,662,399 | B1 | 12/2003 | Vairo | |
| 7,155,770 | B2 * | 1/2007 | Anderson et al. | 15/111 |
| 7,469,444 | B1 * | 12/2008 | Thomas | 15/236.02 |
| 2004/0250365 | A1 * | 12/2004 | Anderson et al. | 15/111 |

* cited by examiner

*Primary Examiner* — Lee D Wilson
(74) *Attorney, Agent, or Firm* — Jerry Fong

(57) ABSTRACT

A push and pull shock absorbing scraper for selective scraping by a push and pull action includes an upper and lower scraper members for scraping ice, snow and frost from windows of a vehicle. The upper scraper member includes a head portion and a shaft portion, where head portion has a scraper blade. The lower scraper member is attached to the shaft portion of the upper scraper member to provide a double push scraping action. The lower scraper member includes a flexible front push blade, a rear pull blade and an attachment portion, where the attachment portion is attached to the shaft portion of the upper scraper member. The handgrip has a bore, where the insert is press-fitted within the bore of the handgrip and a pair of opposite protruding tabs extending outward for preventing transverse movement of the shaft portion of the scraper within the bore of the handgrip. The coil spring is located between the head portion and the handgrip for absorbing the impact force of the reciprocation movement of the head portion of the scraper. The O-ring is located between the head portion and the coil spring to further absorbs the impact force of the head portion of the scraper.

20 Claims, 16 Drawing Sheets

PUSH AND PULL SHOCK ABSORBING SCRAPER

This application is a continuation-in-part of application Ser. No. 10/881,770 filed on Jun. 30, 2004, now U.S. Pat. No. 7,469,444.

BACKGROUND OF THE INVENTION

1. Field of the Invention

The present invention relates generally to the field of ice scrapers. More particularly, the present invention relates to the field of shock absorbing ice scrapers for use in scraping ice, snow or frost accumulating on windshields and windows of vehicles. In particular, the present invention is an improvement of shock absorbing scrapers for scraping by a push and pull action.

2. Description of the Prior Art

Various scrapers have been proposed in the art and implemented for scraping the winter elements off a vehicle's windshield and windows. A number of scrapers are fairly short arcuate devices while others comprise an elongated handle with a scraper blade at one end. In addition, some ice scrapers employ a scraper at one end of an elongated handle with a brush being mounted on the other end. Although the longer ice scrapers described above provide an extended reach, it is difficult for the user to apply sufficient scraping pressure to the scraper blade.

Conventional scrapers have a handle which is grasped in the hand and used to press the scraping edge of the tool against the surface that is being scraped. This manner of scraping exerts considerable stress on the wrist and requires the wrist to be flexed at various angles, and therefore frequently leads to wrist injuries. The amount of force that can be applied to the surface is also somewhat limited because of the limited strength of the wrist and this detracts froth the effectiveness and efficiency of the scraping process.

The problems associated with conventional scrapers have been recognized and efforts to improve the scraper design have been made. However, they have not been altogether successful either functionally or commercially.

U.S. Pat. No. 6,662,399 issued to Vairo on Dec. 16, 2003 discloses an ice scraper which includes an elongated handle portion having a scraper blade mounted at one end and a U-shaped yoke mounted at the other end. The U-shaped yoke has a pair of spaced-apart yoke members which have a U-shaped arm or wrist engaging member and which extends therebetween. An optional brush is secured to the handle portion adjacent the scraper blade but disposed oppositely. This device does not have a shock absorbing means for the scraping head, and thereby causes wrist and hand injure.

U.S. Pat. No. 6,640,943 issued to Daws et al. on Nov. 4, 2003 discloses a shock absorber with sealing ice scraper. The shock absorber includes a piston assembly and a damping fluid cylinder having a first end and defining a damping fluid chamber.

U.S. Pat. No. 5,471,698 issued to Francis et al. on Dec. 5, 1995 discloses a hand tool having interchangeable accessories. It comprises a frame which holds interchangeable working heads for scraping ice and other materials, scrubbing and sanding. The frame pivotally carries the working head at one end. Again, this device does not have a shock absorbing means for the scraping head, and thereby causes wrist and hand injure.

U.S. Pat. No. 5,455,981 issued to Wiese on Oct. 10, 1995 discloses a paint scraper. The paint scraper includes a blade for scraping paint from a surface by pulling and pushing the blade along the surface while the blade is held in pressure contact with the surface. The paint scraper includes a handle carrying the blade with the handle having a first cylindrical portion for grasping in different hand positions with a thumb and fingers of a user's hand and a lever arm extending from the handle, with the lever arm extending substantially at a right angle to the handle and having an opening so as to permit insertion and repositioning of a user's forearm with the lever arm having an arm cradle having an arcuate shape for engaging an extended portion of a user's forearm.

U.S. Pat. No. 4,984,324 issued to Farris on Jan. 15, 1991 discloses a push-pull paint scraper tool which has a two-section handle attached to a support head. The two handle sections are offset at predetermined angles relative to a scraper blade coupling surface portion of the support head. A scraper plate has push and pull scraper blades which is removably mounted onto the support head.

U.S. Pat. No. 4,962,561 issued to Hamilton on Oct. 16, 1990 discloses a scraping device which includes a handle with a looped section for engaging the upper forearm adjacent the elbow. The looped section has a curvature which accommodates a thick winter coat.

U.S. Pat. No. 5,897,119 issued to McMillen on Apr. 27, 1999 discloses a floating wiper seal assembly for sealingly engaging a reciprocating shaft within a hydraulic pump housing.

U.S. Pat. No. 4,813,458 issued to Jacobucci on Mar. 21, 1989 discloses an ice, frost, and snow scraper for vehicle windscreens. The scraper includes a center handle which acts as a fulcrum and two lever arms which act as levers. The two lever arms are incurved and joined each other to form the forearm rest at the rear extremity of the scraper.

U.S. Pat. No. 4,305,175 issued to Burgess, Jr. on Dec. 15, 1981 discloses a scraping tool for scraping ice from an automobile windshield. The tool includes a shell member having two pairs of blades disposed longitudinally along the shell. One blade from each pair is straight and disposed transversely across the shell while the other blade from each pair is arcuate in shape and spaced apart from the first blade at the center portions and joined at the distal ends.

It is highly desirable to have a very efficient and also very effective design and construction of a shock absorbing ice scraper for scraping ice, snow or frost from windows of a vehicle. It is desirable to provide a shock absorbing ice scraper for absorbing impact to the hand and wrist of a user to prevent injuries. It is also desirable to provide an interchangeable scraper head with the shock-absorbing feature of the present invention. It is further desirable to provide an improved shock absorbing scraper utilizing a push and pull action.

SUMMARY OF THE INVENTION

The present invention is a shock absorbing ice scraper for scraping ice, snow and frost from windows of a vehicle or the like surface. The scraper includes a scraper member, a handgrip member, an insert member, a coil spring, and a resilient O-ring. The scraper member includes a head portion and a shaft portion connected to one end of the head portion. The head portion has a scraper blade on the other end. The handgrip member has a bore communicating with an open end. The insert member has a bore communicating with an open end and means for preventing transverse movement of the shaft portion of the scraper member within the bore of the handgrip member. The insert member is press-fitted or over molded within the bore of the handgrip member. The coil spring is located between the head portion and the handgrip member for absorbing the impact force of the reciprocation movement of the head portion of the scraper member. The resilient O-ring is located between the one end of the head portion and the coil spring to further absorbs the impact force of the head portion of the scraper member.

It is an object of the present invention to provide an improved ice scraper.

It is also an object of the present invention to provide a shock absorbing ice scraper which is easily gripped with one hand to exert pressure on the windshield or a like surface for scraping so that even the most tenacious ice can be removed.

It is an additional object of the present invention to provide a shock absorbing ice scarper for absorbing impact force of the ice scraper, thereby preventing injure to the wrist and hand of a user.

It is a further object of the present invention to provide an improved handgrip member which includes a thumb rest, a finger separator, a closed palm striking end, and a curved portion for providing pushing angle for the user's hand.

It is still a further object of the present invention to provide a shock absorbing ice scraper which is reversible in that pressure may be applied to either a scraper blade or a plurality of spaced apart scraping ribs.

It is still a further object of the present invention to provide a shock absorbing ice scraper which is durable in use, refined in appearance, and simple and economical to construct.

It is also a further object of the present invention to provide a shock absorbing scraper for scraping by a push and pull action.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

In the following description of the preferred embodiment, reference is made to the accompanying drawings which form a part hereof, and in which is shown by way of illustration a specific embodiment in which the present invention may be practiced. It is to be understood that other embodiments may be utilized and structural changes may be made without departing from the scope of the present invention.

Figure 2:
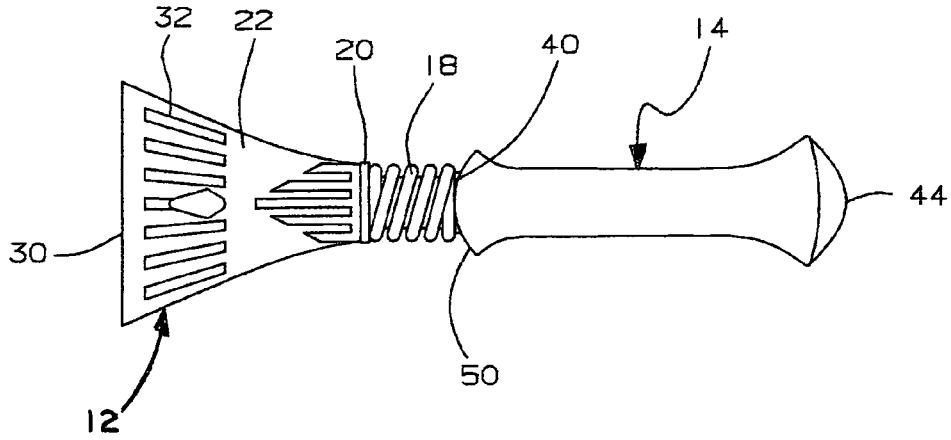
FIG. 2 is a top plan view of the present invention shock absorbing ice scraper shown in FIG. 1.
Figure 1:
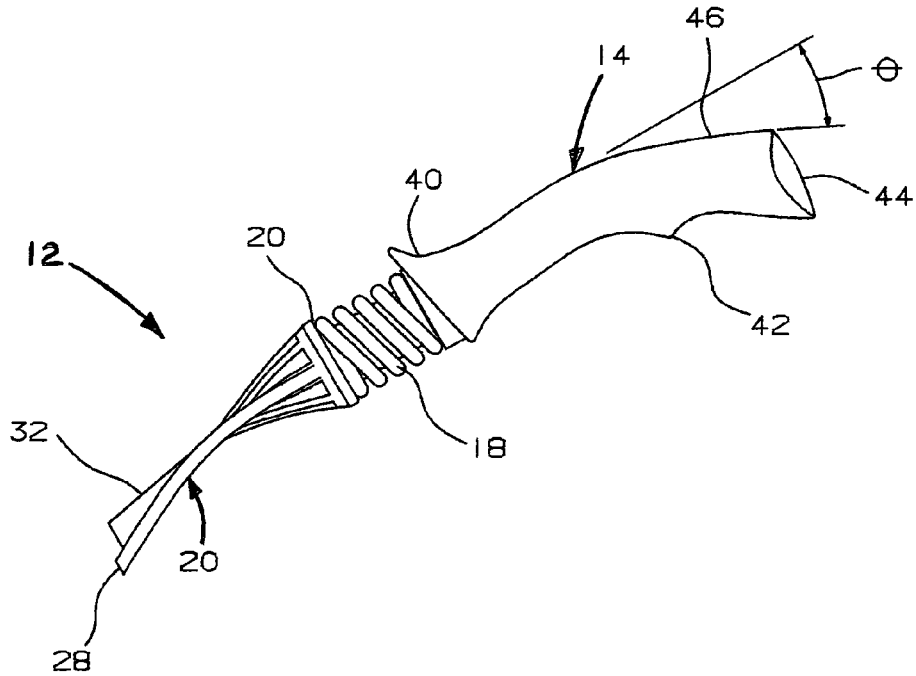
FIG. 1 is a side elevational view of the present invention shock absorbing ice scraper.
Figure 3:
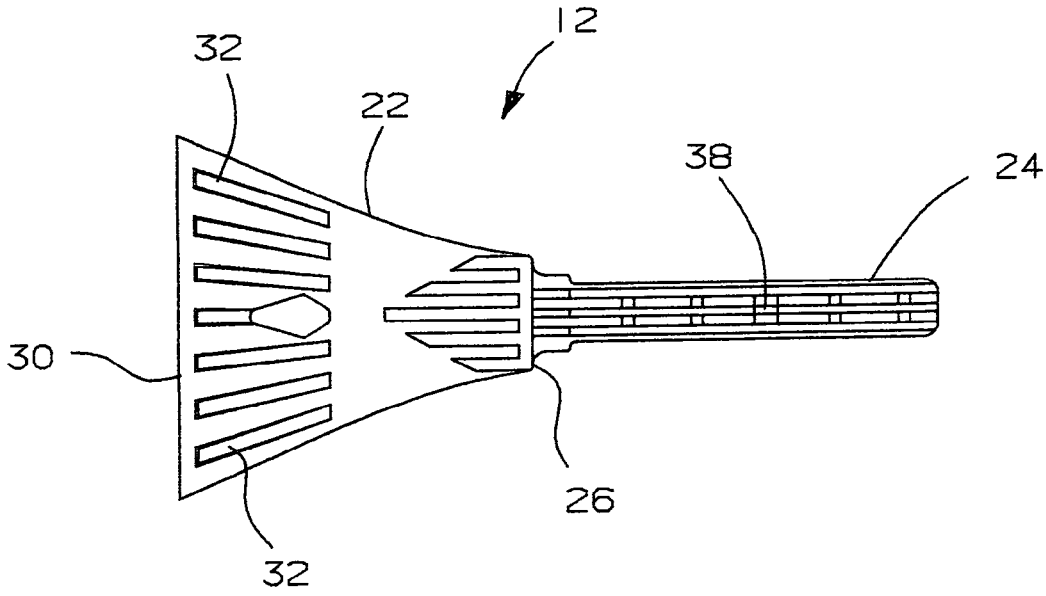
FIG. 3 is a top plan view of the scraper member of the present invention shock absorbing ice scraper.
Figure 4:
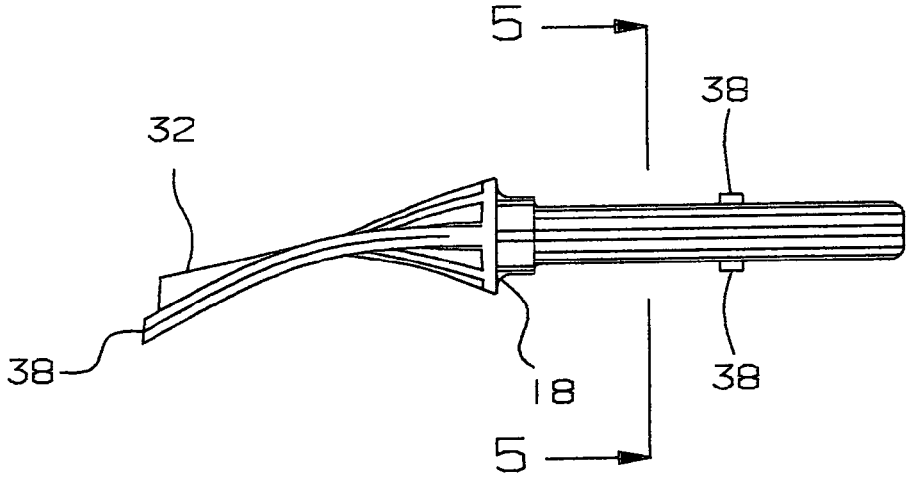
FIG. 4 is side elevational view of the scraper member shown in FIG. 3.
Figure 5:
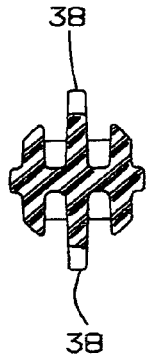
FIG. 5 is an enlarged cross-sectional view taken along line 5-5 of FIG. 4.

Referring to FIG. 1, there is shown the present invention shock absorbing ice scraper referred to generally by the reference numeral 10. The shock absorbing ice scraper 10 is used for removing ice, snow or frost from vehicle windshields and the like. The scraper 10 includes an interchangeable scraper member 12, a longitudinal contour handgrip member 14, a longitudinal rigid insert member 16, a resilient coil spring 18, and a resilient O-ring 20.

Referring to FIGS. 1 through 4, the interchangeable scraper member 12 includes a head portion 22 and an elongated shaft portion 24 integrally formed to a narrow end 26 of the head portion 22 and extends outwardly therefrom. The head portion 22 has an angular ice scraper blade 28 on the wide end 30 and a plurality of spaced apart teeth 32 on a top surface 34 and located adjacent to the ice scraper blade 28. The head portion 22 has a plurality of short spaced apart ribs for strengthening and reinforcing the narrow end 26. The shaft portion 24 is constructed with a plurality of spaced apart longitudinal ribs 36 as shown for reducing cost to produce the scraper member 12. A pair of opposite protruding tabs or flanges 38 (see FIG. 4) are integrally form with one of the ribs 36 and extend outwardly therefrom. These protruding tabs 38 lock the shaft portion 24 in place and restrict the shaft portion 24 from leaving the handgrip member 14. The scraper member 12 may be constructed from plastic material, metal material or other suitable materials for scraping different surfaces as desired.

Figure 8:
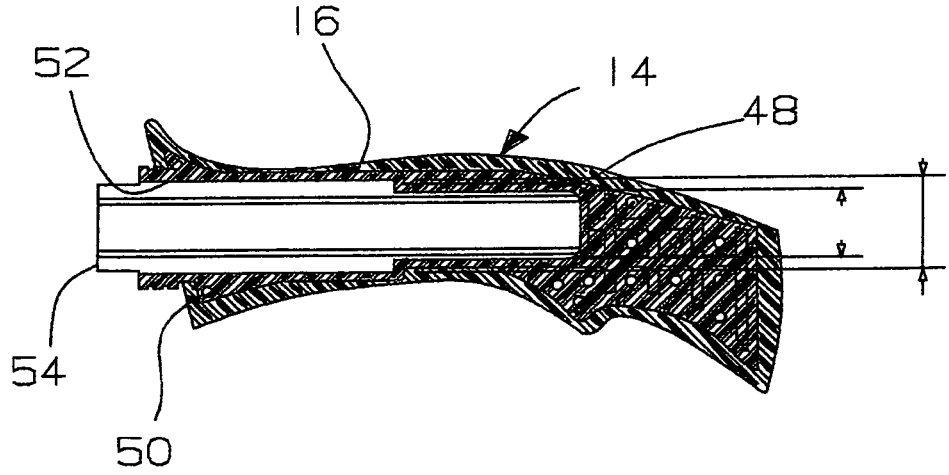
FIG. 8 is a cross-sectional view taken along line 8-8 of FIG. 7.

Referring to FIGS. 1, 2, 7, and 8, the handgrip member 14 is preferably angular or curved. The handgrip member 14 includes a thumb rest 40, a finger separator 42, a closed palm striking end 44, and a curved portion 46 adjacent to the palm striking end 44. As seen in FIGS. 1 and 8, the handgrip member 14 has the curved portion 46 for providing a pushing angle θ for the user's hand. The pushing angle θ may be approximately in the range of 10°-40° for providing a contour feel to the handgrip member 14. The handgrip member 14 has a generally cylindrical bore 48 which is shaped with a unique locking mechanism as shown in FIG. 8. The handgrip member 14 further has an open end 50 which communicates with the bore 48. The handgrip member 14 may be constructed of rubberize material, thermo plastic or etc. for further providing an absorbing means to the impact force.

Figure 9:
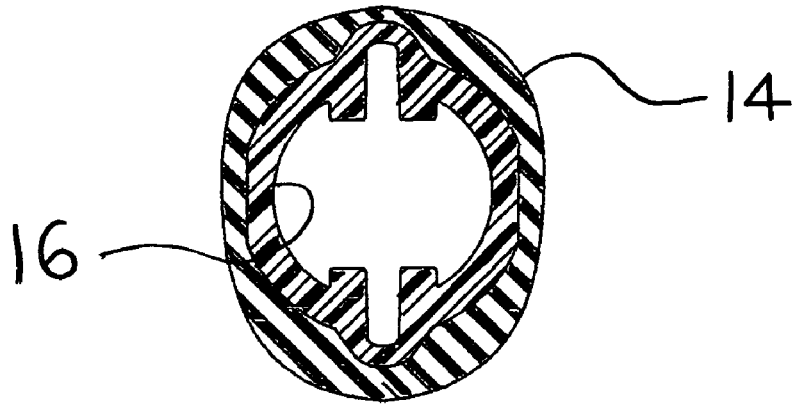
FIG. 9 is an enlarged cross-sectional view taken along line 9-9 of FIG. 7.
Figure 10:
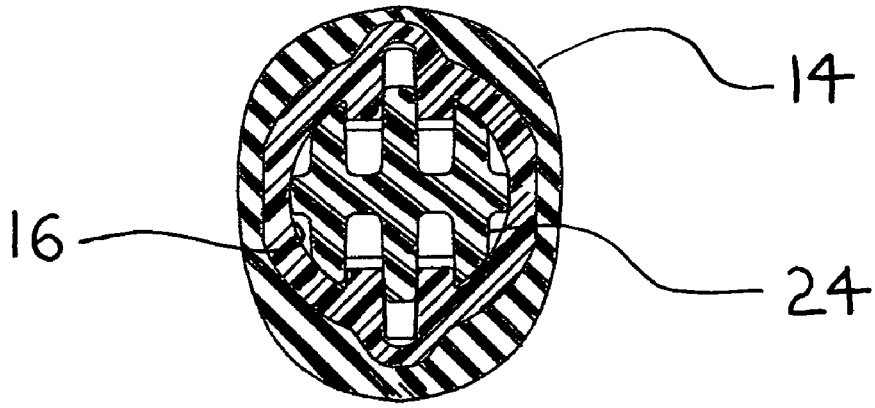
FIG. 10 is an enlarged cross-sectional view taken along line 10-10 of FIG. 2.

Referring to FIGS. 7, 8, 9, and 10, the insert member 16 has a generally cylindrical shaped bore 52 which communicates with an open end 54 and means for preventing transverse movement of the shaft portion 24 of the scraper member 12 within the cylindrical bore 48 of the handgrip member 14. The insert member 16 further has an exterior shaped structure that corresponds with the interior of the bore 48 of the handgrip member 14 for providing the unique locking mechanism as shown in FIGS. 9 and 10. The insert member 16 is press-fitted or over molded within the bore 48 of the handgrip member 14 such that the open end 54 extends partially out from the handgrip member 14. The insert member 16 has slotted openings thereto so that the protruding tabs 38 of the shaft portion 24 can be slide thereto and restrict the movement of the scraper member 12. What is also unique about the shock absorbing ice scraper 10 is the interlocking mechanism between the shaft portion 24 of the scraper member 12, the insert member 16, and the handgrip member. FIGS. 9 and 10 show the interlocking mechanism between these three parts of the shock absorbing ice scraper 10.

The resilient coil spring 18 is fitted between the open end 54 of the insert member 16 and the narrow end 26 of the head portion 22 for absorbing the impact force of the reciprocation movement of the head portion 22 of the scraper member 12. What is also unique about the present invention shock absorbing ice scraper is that the coil spring 18 is also utilized as an energy absorber, displacement of the impact force over time, and reduction of stress to the user's hand.

Figure 6:
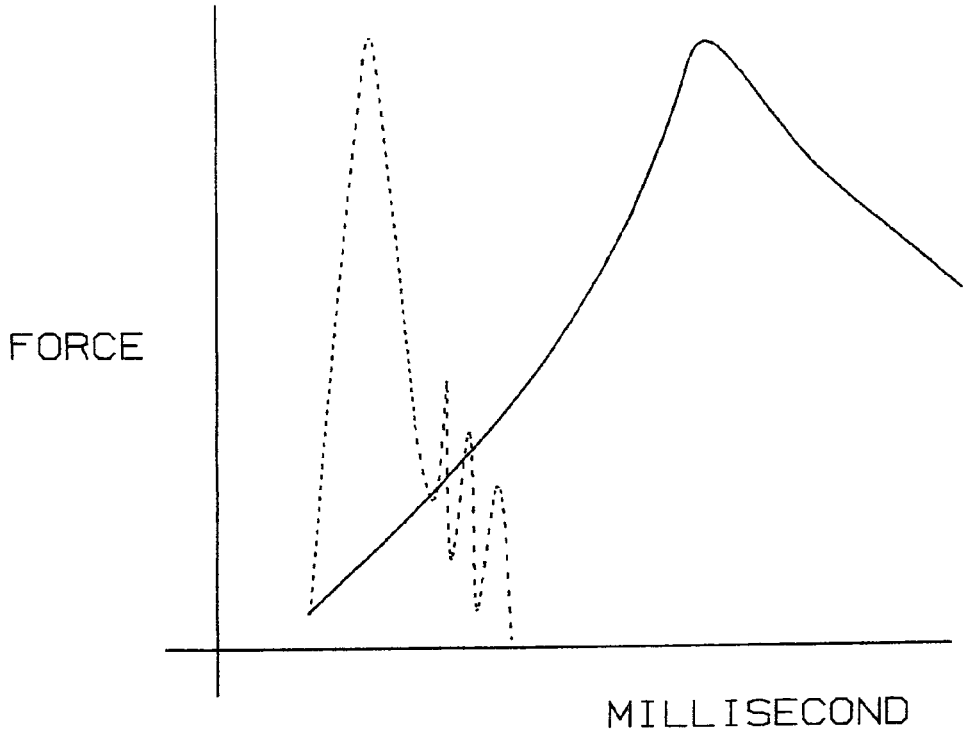
FIG. 6 is a graph showing an impact force over time.
Figure 7:
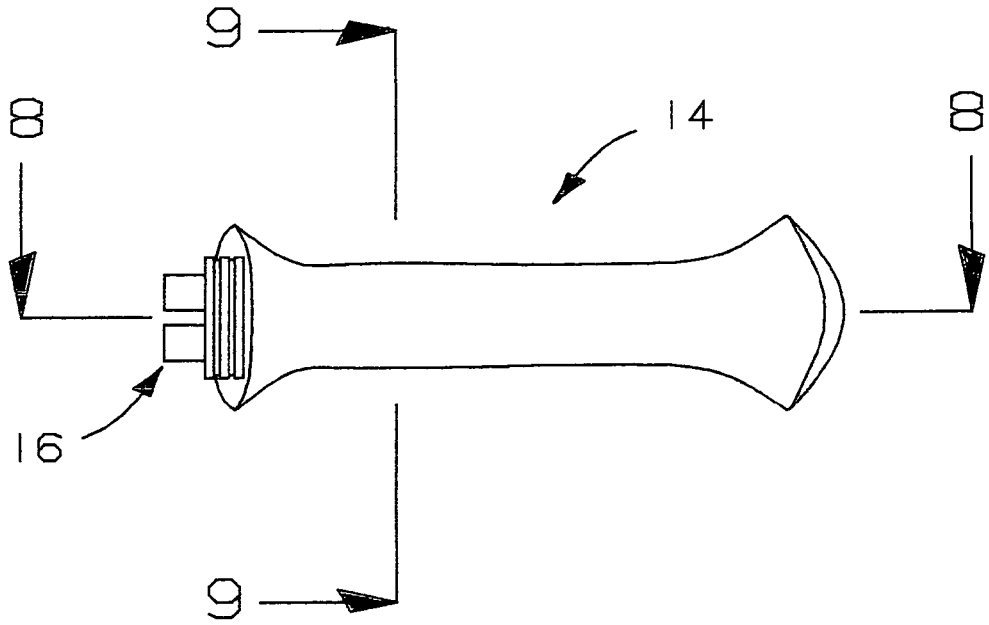
FIG. 7 is a top plan view of the insert member and the handgrip member of the present invention shock absorbing ice scraper.

FIG. 6 shows a graph of the impact force of a conventional ice scraper and the impact force of the present invention shock absorbing ice scraper. The dashed line shows the impact force immediately on the conventional ice scraper while the solid line shows the impact force of the present invention shock absorbing ice scraper over time and dissipates over time as shown.

The resilient O-ring 20 is captured between the narrow end 26 of the head portion 22 and the coil spring 18 to further absorbs the impact force of the head portion 22 of the scraper member 12. The O-ring 20 may be a circular member and constructed of rubber material, plastic material or other suitable materials.

Figure 11:
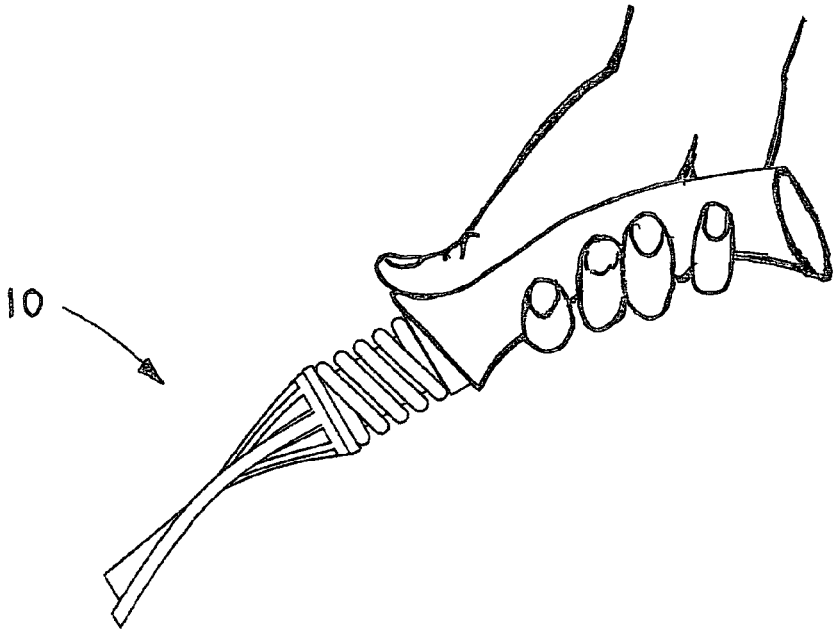
FIG. 11 is a side elevational view of the present invention shock absorbing ice scraper showing a push position.
Figure 12:
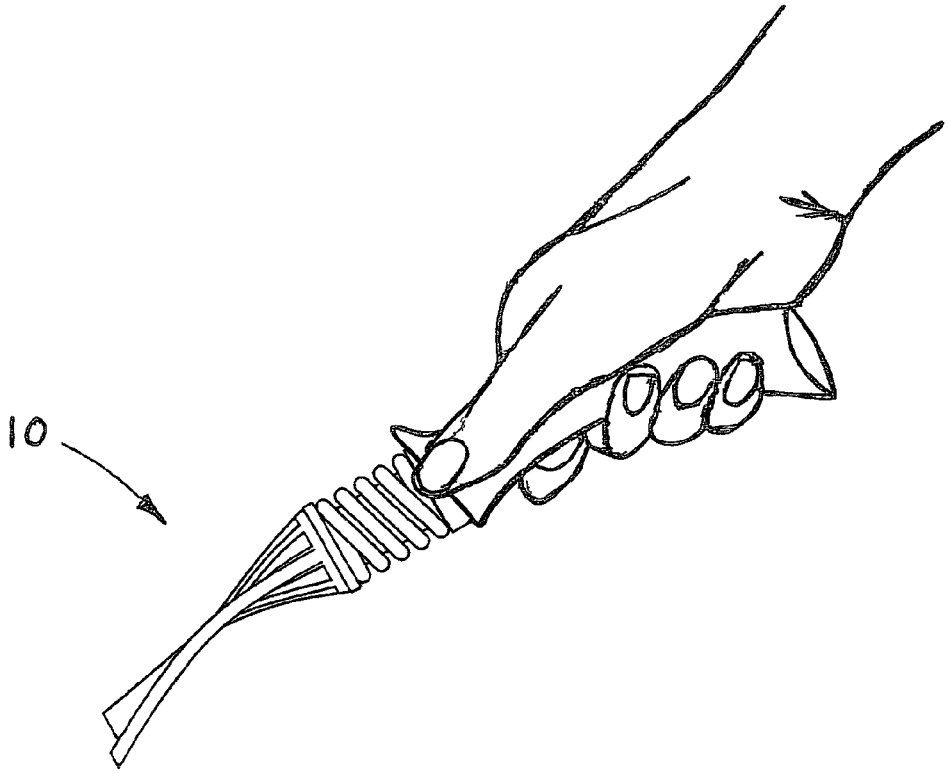
FIG. 12 is a side elevational view of the present invention shock absorbing ice scraper showing a push position in another hand position.
Figure 13:
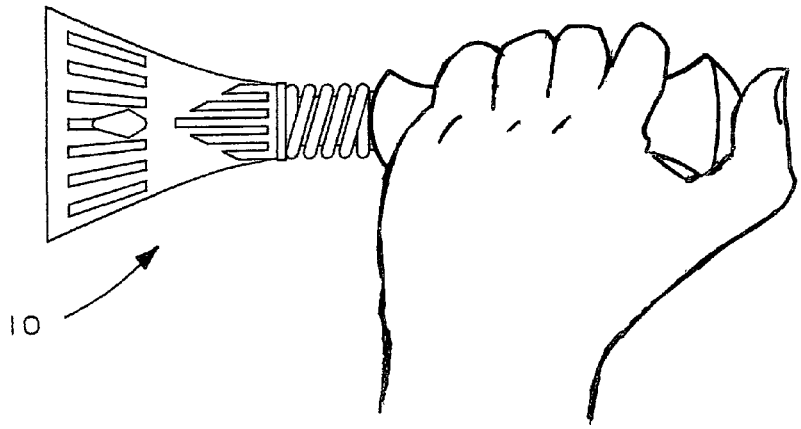
FIG. 13 is a side elevational view of the present invention ice scraper showing a single-handed side chisel position.
Figure 14:
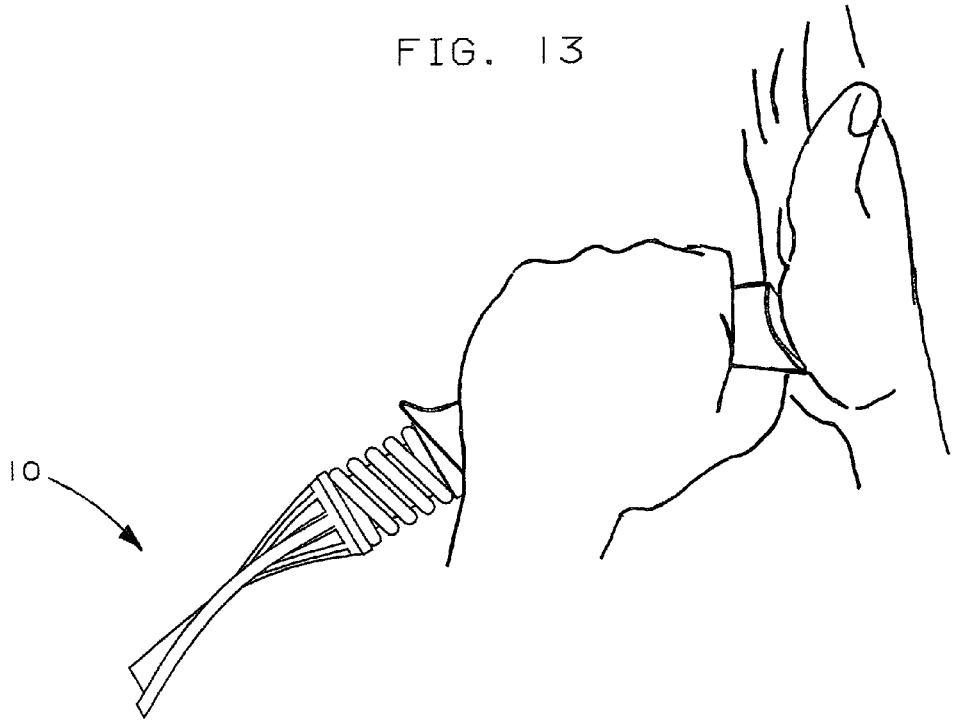
FIG. 14 is a side elevational view of the present invention ice scraper showing a two-handed side chisel position.
Figure 15:
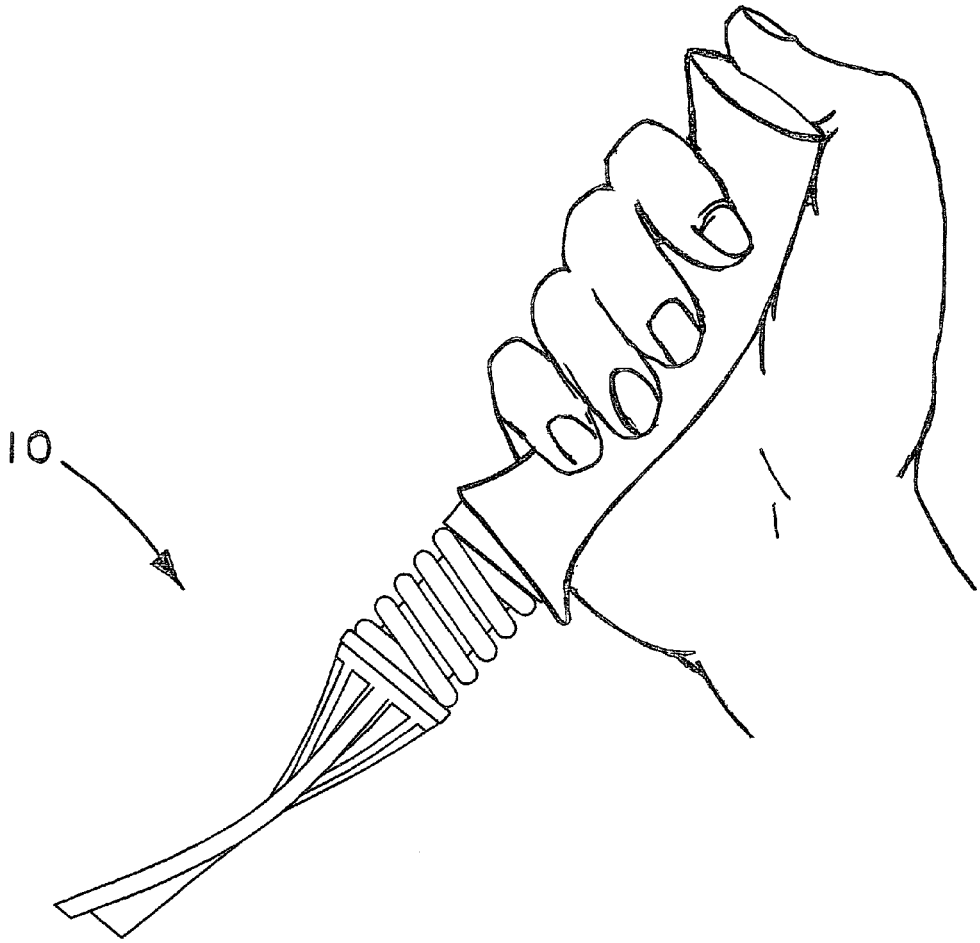
FIG. 15 is a side elevational view of the present invention shock absorbing ice scraper showing a single-handed down chisel position.
Figure 16:
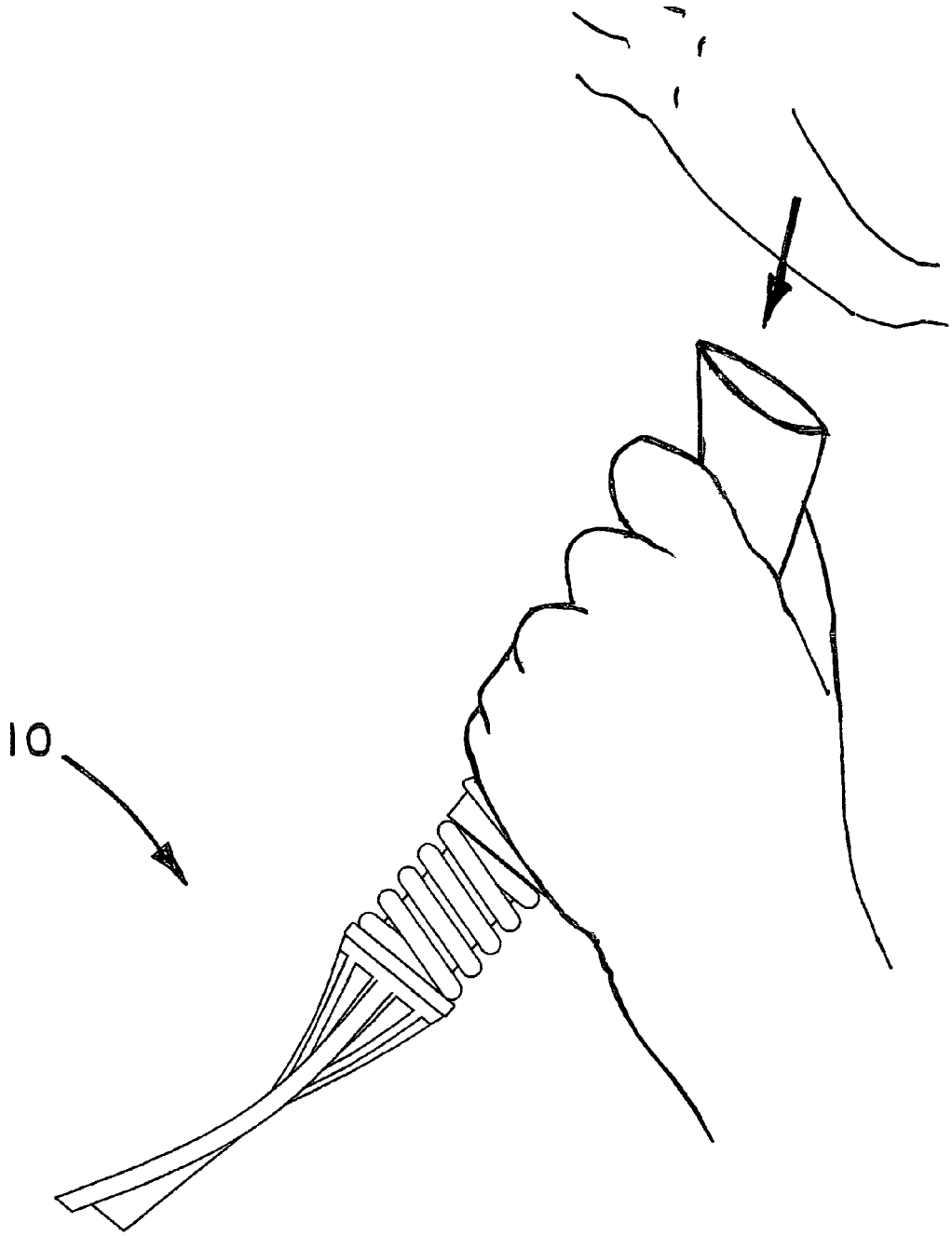
FIG. 16 is a side elevational view of the present invention ice scraper showing a two-handed down chisel position.

The present invention shock absorbing ice scraper 10 can be utilized in many different positions as shown in FIGS. 11 through 16. FIG. 11 shows the shock absorbing ice scraper 10 with a user's hand 2 in a push position. FIG. 12 shows the shock absorbing ice scraper 10 with the user's hand 2 in a rotating push position. FIG. 13 shows the shock absorbing ice scraper 10 with the user's hand 2 in a single-handed side chisel position. FIG. 14 shows the shock absorbing ice scraper 10 with the user's hand 2 in a two-handed side chisel position. FIG. 15 shows the shock absorbing ice scraper 10 with the user's hand 2 in a single-handed down chisel position. FIG. 16 shows the shock absorbing ice scraper 10 with the user's hand 2 in a two-handed down chisel position.

Figure 17:
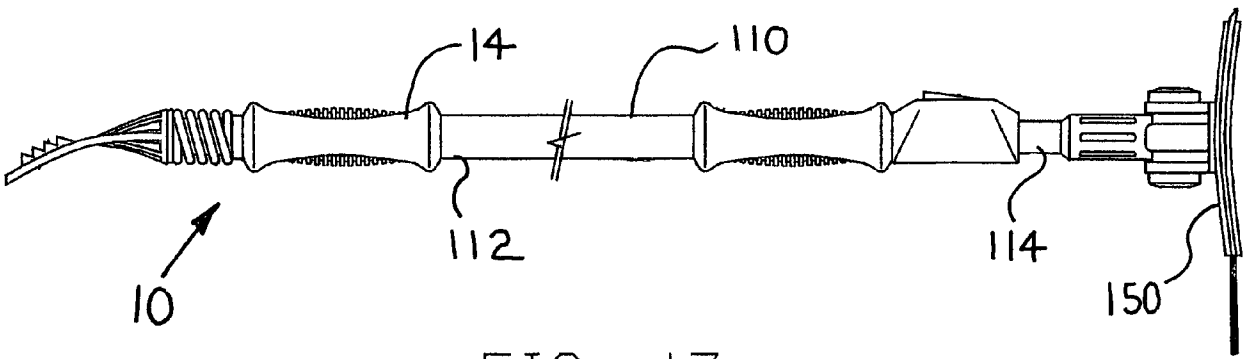
FIG. 17 is a top plan view of the present invention shock absorbing ice scraper utilizing an extension pole.
Figure 18:
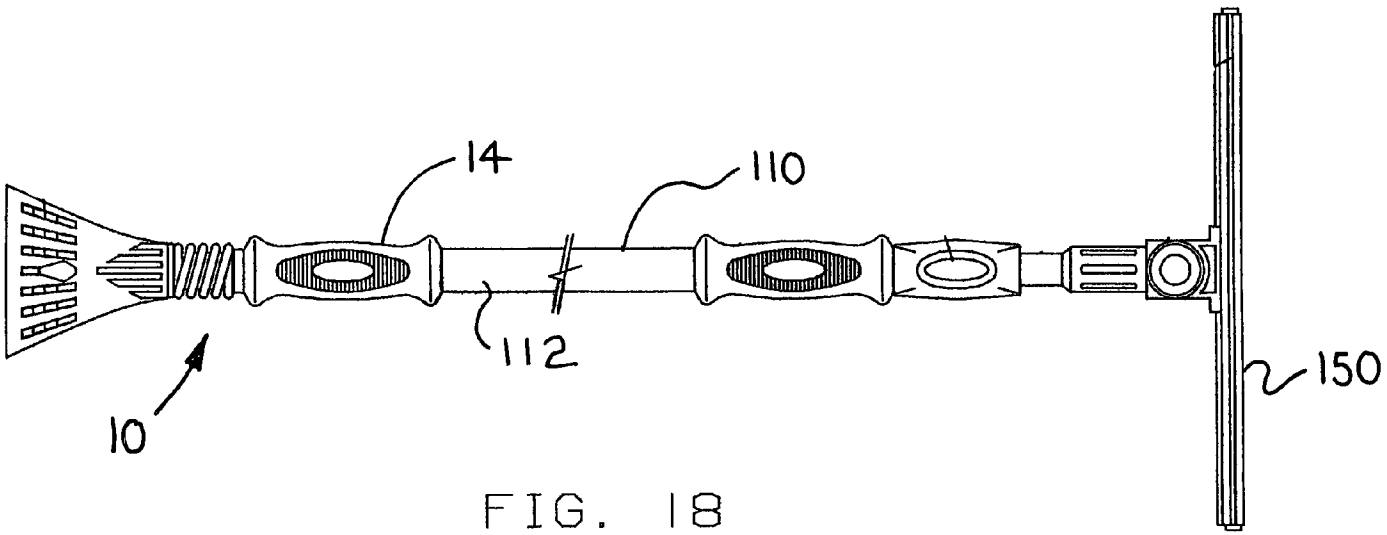
FIG. 18 is a side elevational view of the shock absorbing ice scraper shown in FIG. 17.

Referring to FIGS. 17 and 18, there is shown the present invention shock absorbing ice scarper 10 which can be utilized with an extension pole 110. One end 112 of the extension pole 110 may be conformed to the handgrip member 14 of the ice scraper 10 while the other end 114 may have a cleaning blade or etc. 150.

Figure 19:
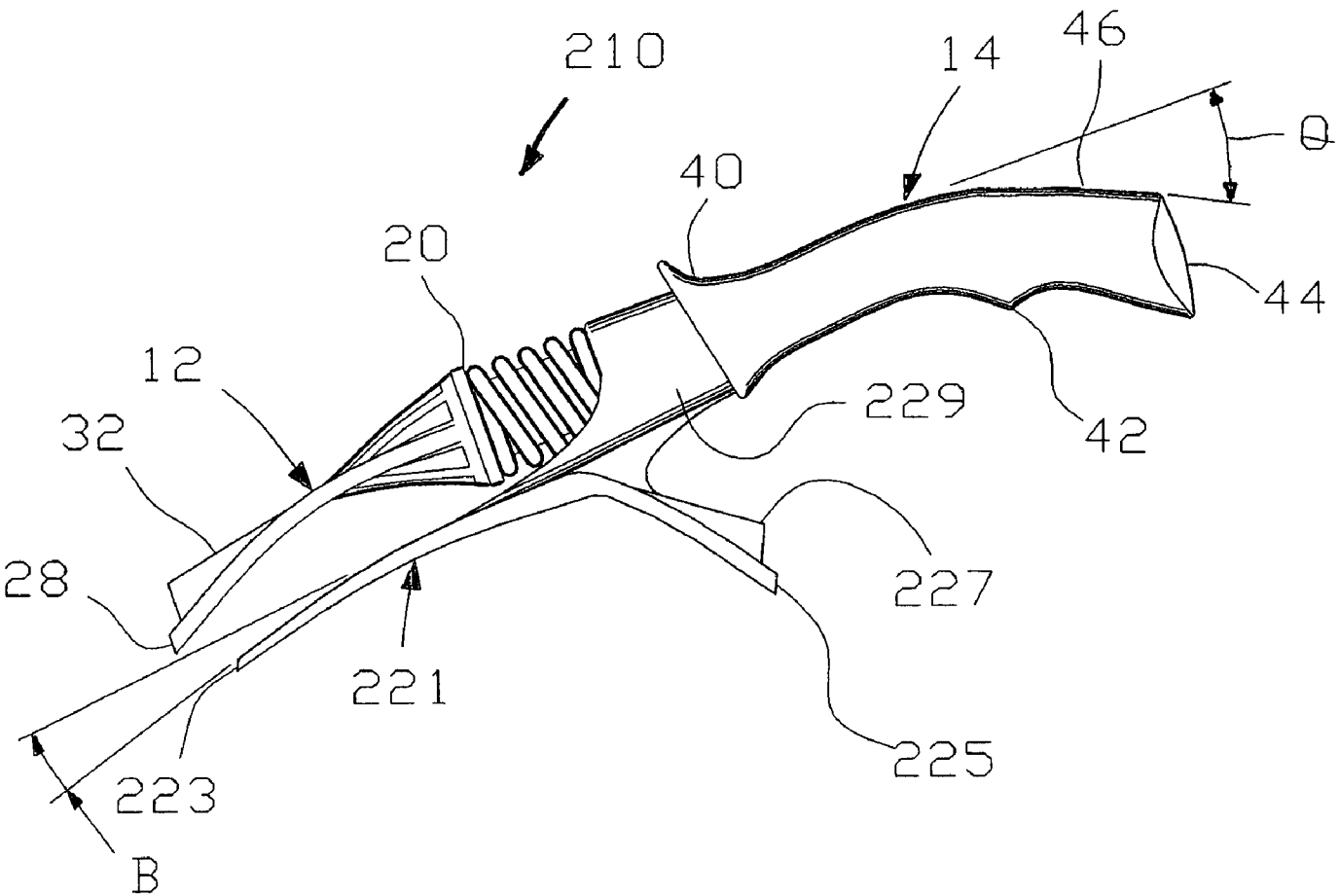
FIG. 19 is a side elevational view of the present invention push and pull shock absorbing scraper.
Figure 20:
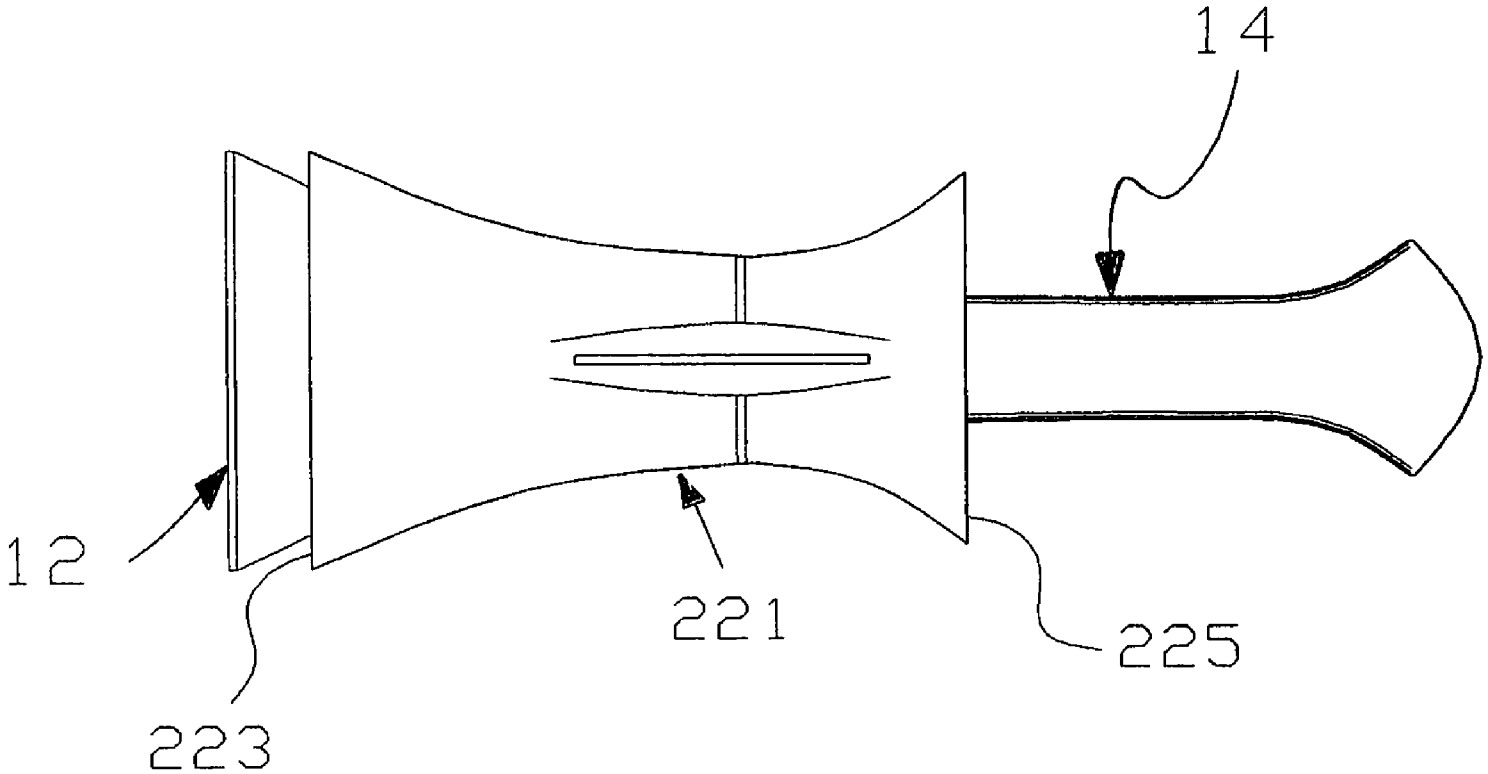
FIG. 20 is a bottom plan view of the push and pull shock absorbing scraper shown in FIG. 19.

Referring to FIGS. 19 through 24, there is shown an improvement of the present invention push and pull shock absorbing scraper 210 for selective scraping by a push and pull action. In this embodiment, the push and pull shock absorbing scraper 210 assembles and functions similarly to the previously described embodiment above except that the shock absorbing scraper includes a lower scraper member 221. FIGS. 19 though 24 will be used to describe another embodiment of the present invention push and pull shock absorbing scraper 210. In addition, all of the parts of this embodiment which are the same as the previous embodiment have the same reference numbers as shown in FIGS. 1 through 18. The new parts are numbered with new reference numbers starting with 200.

The push and pull shock absorbing scraper 210 includes an interchangeable upper scraper member 12, a longitudinal contour handgrip member 14, a longitudinal rigid insert member 16, a resilient coil spring 18, and a resilient O-ring 20.

The interchangeable upper scraper member 12 includes a head portion 22 and an elongated shaft portion 24 integrally formed to a narrow end 26 of the head portion 22 and extends outwardly therefrom. The head portion 22 has an angular scraper blade 28 on the wide end 30 and a plurality of spaced apart teeth 32 on a top surface 34 and located adjacent to the scraper blade 28. The head portion 22 has a plurality of short spaced apart ribs for strengthening and reinforcing the narrow end 26. The shaft portion 24 is constructed with a plurality of spaced apart longitudinal ribs 36 as shown for reducing cost to produce the scraper member 12. A pair of opposite protruding tabs or flanges 38 (see FIG. 4) are integrally form with one of the ribs 36 and extend outwardly therefrom. These protruding tabs 38 lock the shaft portion 24 in place and restrict the shaft portion 24 from leaving the handgrip member 14. The scraper member 12 may be constructed from plastic material, metal material or other suitable materials for scraping different surfaces as desired.

The handgrip member 14 is preferably angular or curved. The handgrip member 14 includes a thumb rest 40, a finger separator 42, a closed palm striking end 44, and a curved portion 46 adjacent to the palm striking end 44. The handgrip member 14 has the curved portion 46 for providing a pushing angle θ for the user's hand. The pushing angle θ may be approximately in the range of 10°-40° for providing a contour feel to the handgrip member 14. The handgrip member 14 has a generally cylindrical bore 48 which is shaped with a unique locking mechanism. The handgrip member 14 further has an open end 50 which communicates with the bore 48. The handgrip member 14 may be constructed of rubberize material, thermo plastic or etc. for further providing an absorbing means to the impact force.

The insert member 16 has a generally cylindrical shaped bore 52 which communicates with an open end 54 and means for preventing transverse movement of the shaft portion 24 of the scraper member 12 within the cylindrical bore 48 of the handgrip member 14. The insert member 16 further has an exterior shaped structure that corresponds with the interior of the bore 48 of the handgrip member 14 for providing the unique locking mechanism. The insert member 16 is press-fitted or over molded within the bore 48 of the handgrip member 14 such that the open end 54 extends partially out from the handgrip member 14. The insert member 16 has slotted openings thereto so that the protruding tabs 38 of the shaft portion 24 can be slide thereto and restrict the movement of the scraper member 12.

The resilient coil spring 18 is fitted between the open end 54 of the insert member 16 and the narrow end 26 of the head portion 22 for absorbing the impact force of the reciprocation movement of the head portion 22 of the scraper member 12. What is also unique about the present invention shock absorbing ice scraper is that the coil spring 18 is also utilized as an energy absorber, displacement of the impact force over time, and reduction of stress to the user's hand.

The resilient O-ring 20 is captured between the narrow end 26 of the head portion 22 and the coil spring 18 to further absorbs the impact force of the head portion 22 of the scraper member 12.

Figure 21:
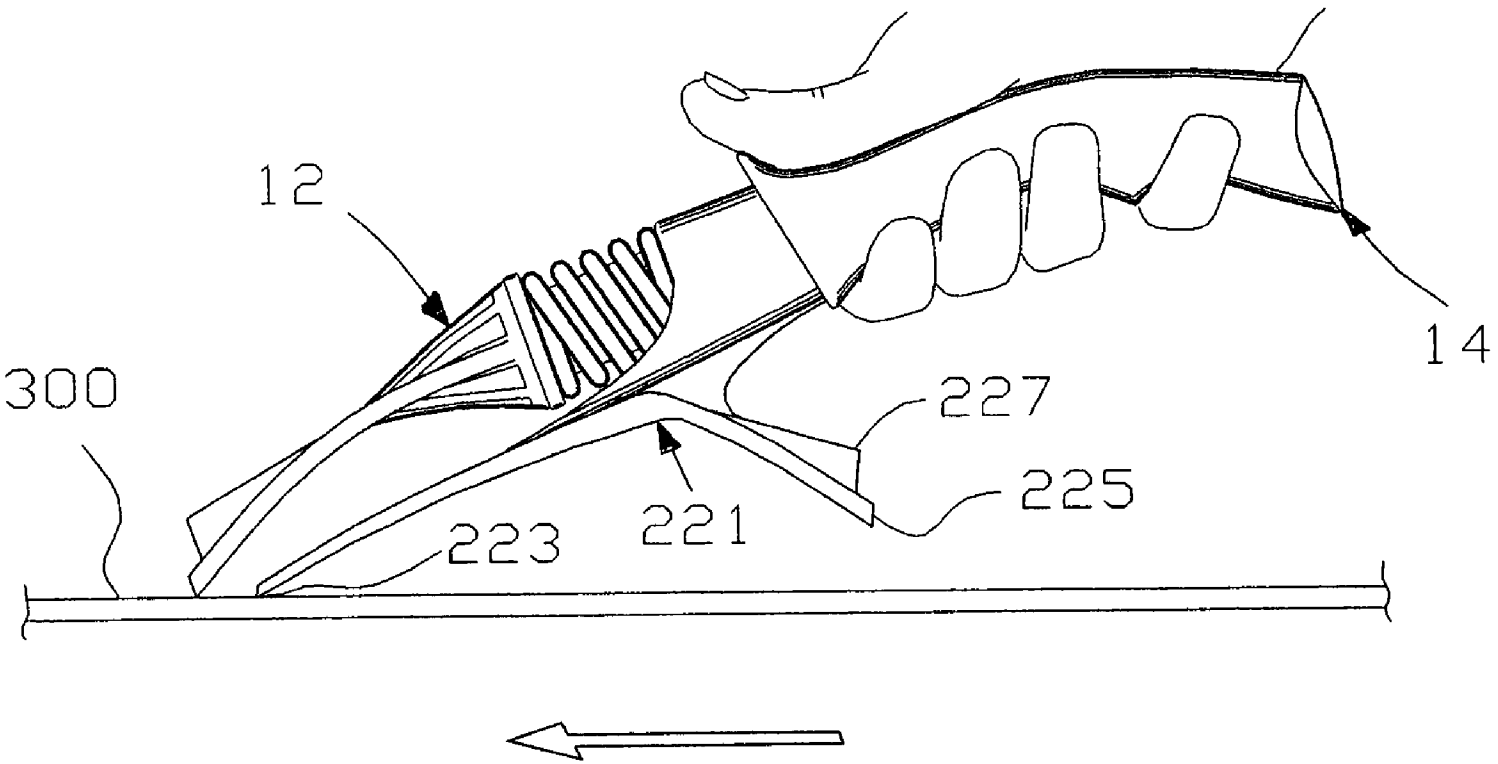
FIG. 21 is a side elevational view of the push and pull shock absorbing scraper shown in FIG. 19 showing the pushing action of the scraper.
Figure 22:
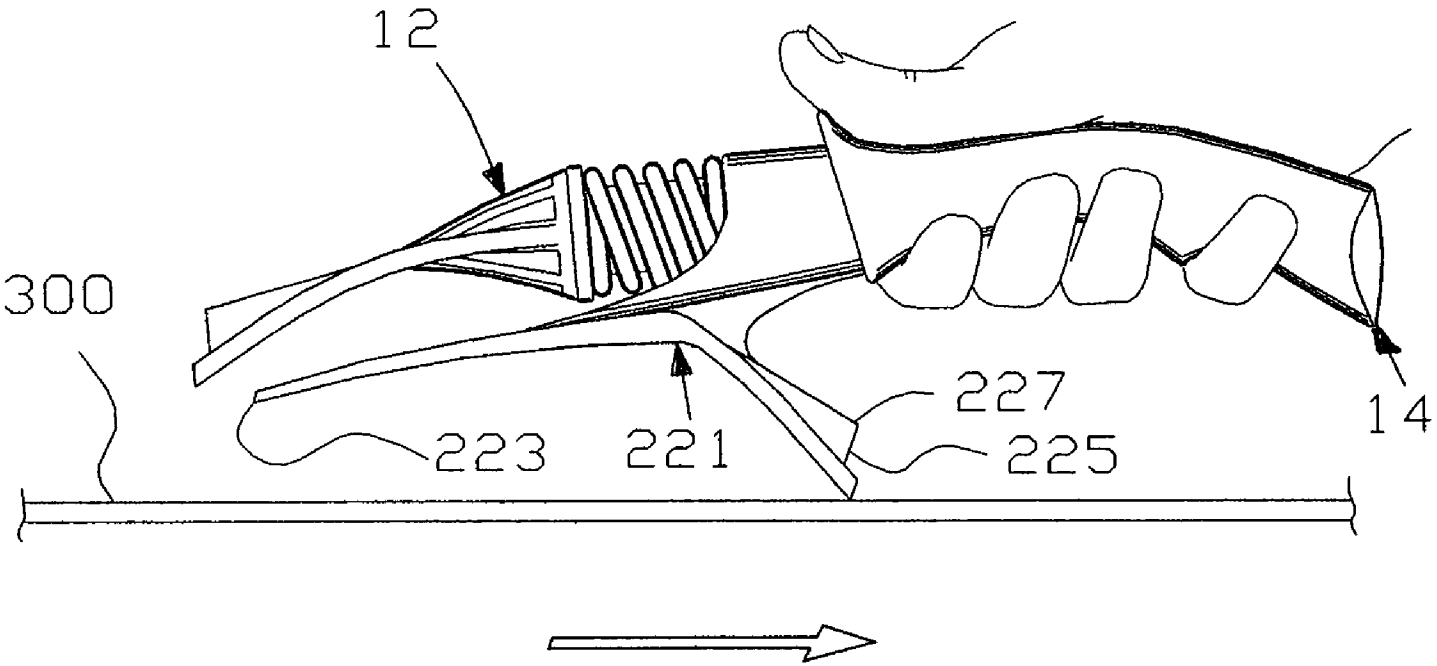
FIG. 22 is a side elevational view of the push and pull shock absorbing scraper shown in FIG. 19 showing the pulling action of the scraper.
Figure 23:
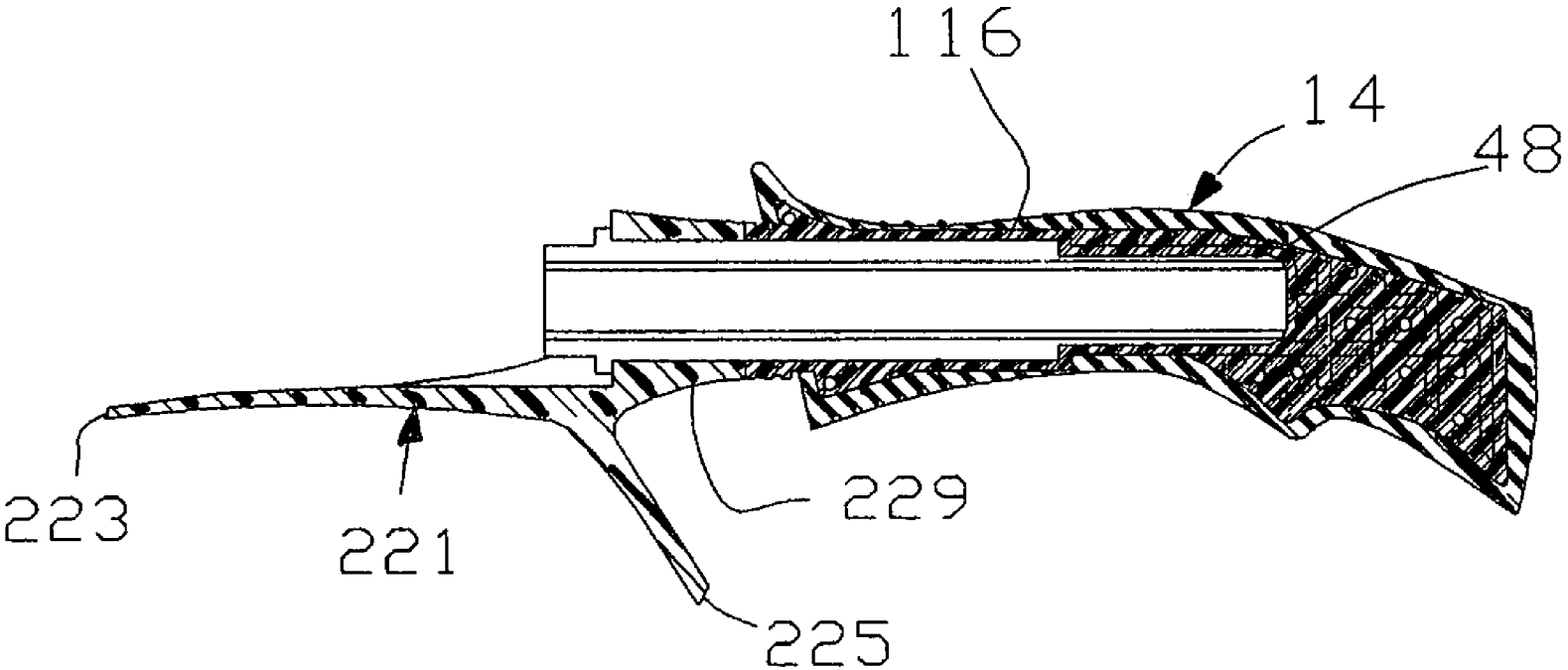
FIG. 23 is a longitudinal cross-sectional view of the present invention shown in FIG. 19, showing an interlocking mechanism of the lower scraper member.
Figure 24:
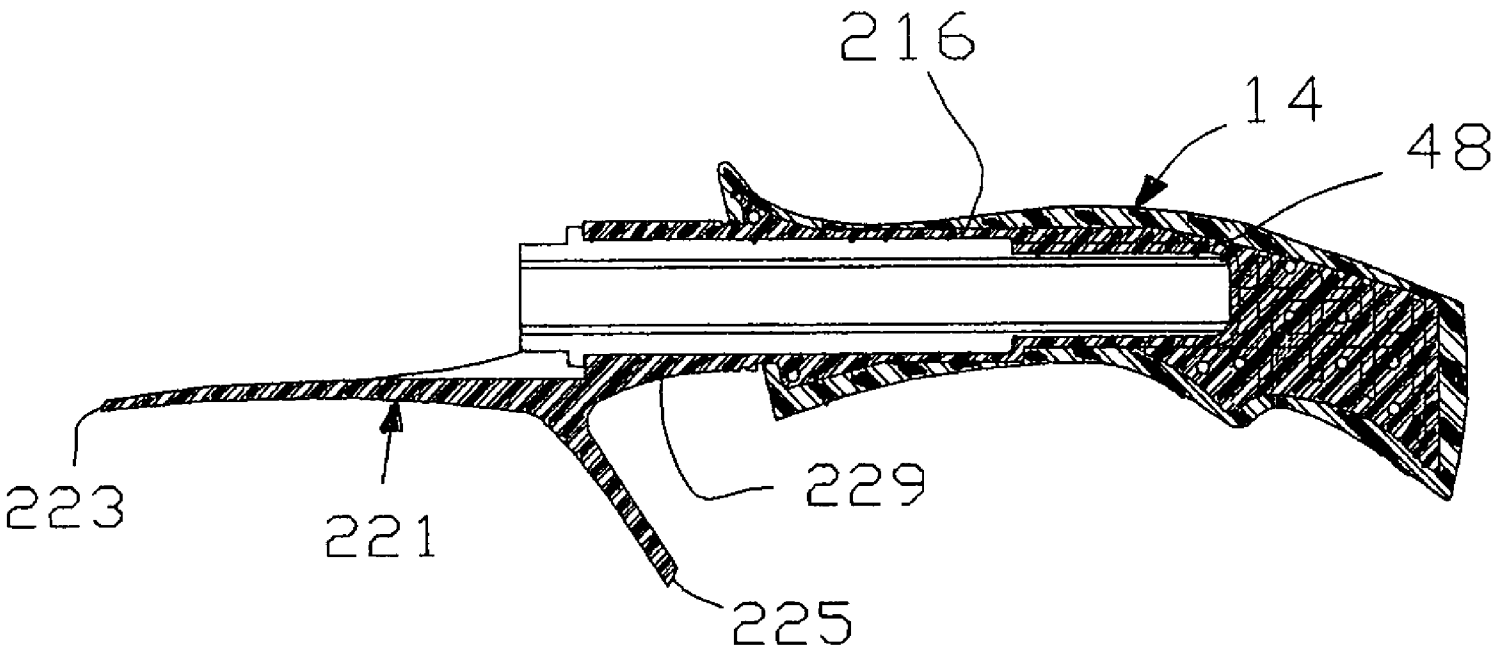
FIG. 24 is a longitudinal cross-sectional view of the present invention shown in FIG. 19, showing the lower scraper member integrally attached.

A lower or second scraper member 221 can be integrally connected (see FIG. 24) or attached (see FIG. 23) to the shaft portion 24 of the upper scraper member 12 to provide a double push scraping action as shown in FIG. 21. The lower scraper member 221 can be attached by an interlocking mechanism shown previously in FIGS. 9 and 10. The lower scraper member 221 includes a flexible front push blade 223, a rear pull blade 225 and an attachment portion 229. The front push blade 223 is disposed for push action scraping engagement against a work-piece 300 and extends outwardly and transversely to the scraper blade 28 of the upper scraper member 12. The rear pull blade 225 is disposed for pull action scraping engagement against the work-piece 300 (see FIG. 22) and projects transversely and parallel to the push blade 223. The upper surface of the rear pull blade 225 has a plurality of spaced apart ribs 227 for strengthening and reinforcing the rear pull blade 225. The attachment portion 229 can be integrally connected (see FIG. 24) or attached by conventional means (see FIG. 23). What is unique about the push and pull shock absorbing scraper 210 is the double push scraping action as shown in FIG. 19 and the pull scraping action shown in FIG. 22.

The upper and lower scraper members 12 and 221 are separated by an angle β in the range of approximately 5°-20° for providing a flexible pushing action. The lower scraper 221 may be constructed from semi-rigid plastic material or other suitable materials for scraping different surfaces as desired and providing flexibility of the push blade 223 to bend as desired.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing form the spirit and scope of the invention, the invention resides in the claims hereinafter appended.

What is claimed is:

1. A shock absorbing scraper, comprising:

(a) a first scraper member having a head portion and a shaft portion connected to one end of the head portion, the head portion having a scraper blade on the other end;

(b) a second scraper member having a push blade extending outwardly and transversely to said scraper blade of said first scraper member, a pull blade projecting transversely and parallel to the push blade, and an attachment portion for attaching to said shaft portion of said first scraper member, where the push blade is disposed for push scraping engagement against a work-piece and the pull blade is disposed for pull scraping engagement against the work-piece;

(c) a handgrip member having a bore communicating with an open end;

(d) an insert member having a bore communicating with an open end and means for preventing transverse movement of said shaft portion of said first scraper member within said bore of said handgrip member, the insert member positioned within said bore of said handgrip member; and (e) spring means for absorbing the impact of the reciprocation movement of said first scraper member.

2. The shock absorbing scraper in accordance with claim 1 further comprising a resilient member located between said one end of said head portion and said spring means to further absorb said impact of said first and second scraper members.

3. The shock absorbing scraper in accordance with claim 1 wherein said spring means is a coil spring.

4. The shock absorbing scraper in accordance with claim 1 wherein shaft portion includes means for restricting said head portion from leaving said handgrip member.

5. The shock absorbing scraper in accordance with claim 4 wherein said means for restricting said head portion includes a pair of opposite protruding tabs extending outwardly.

6. The shock absorbing scraper in accordance with claim 1 wherein said second scraper member is made of semi-rigid plastic material.

7. A shock absorbing scraper, comprising:

(a) a first scraper member having a head portion and a shaft portion connected to one end of the head portion, the head portion having a scraper blade on the other end;

(b) a second scraper member having a push blade extending outwardly and transversely to said scraper blade of said first scraper member, a pull blade projecting transversely and parallel to the push blade, and an attachment portion for attaching to said shaft portion of said first scraper member, where the push blade is disposed for push scraping engagement against a work-piece and the pull blade is disposed for pull scraping engagement against the work-piece;

(c) a handgrip member having a bore communicating with an open end;

(d) an insert member having a bore communicating with an open end and at least one protruding tab extending outwardly for preventing transverse movement of said shaft portion of said first scraper member within said bore of said handgrip member, the insert member positioned within said bore of said handgrip member; and (e) spring means for absorbing the impact of the reciprocation movement of said first scraper member.

8. The shock absorbing scraper in accordance with claim 7 further comprising a resilient member located between said one end of said head portion and said spring means to further absorbs said impact of said first and second scraper members.

9. The shock absorbing scraper in accordance with claim 7 further comprising a plurality of spaced apart teeth on a surface of said head portion and adjacent to said scraper blade.

10. The shock absorbing scraper in accordance with claim 7 wherein shaft portion includes means for restricting said head portion from leaving said handgrip member.

11. The shock absorbing scraper in accordance with claim 10 wherein said means for restricting said head portion includes a pair of opposite protruding tabs extending outwardly.

12. The shock absorbing scraper in accordance with claim 7 wherein said spring means is a coil spring.

13. The shock absorbing scraper in accordance with claim 7 wherein said second scraper member is made of semi-rigid plastic material.

14. A shock absorbing scraper for scraping a surface to be scraped and absorbing the impact of the scraper, comprising:

(a) an upper scraper member having a head portion and a shaft portion integrally formed with one end of the head portion, the head portion having a scraper blade on the other end, the shaft portion having means for preventing transverse movement of the head portion;

(b) a lower scraper member having a flexible push blade extending outwardly and transversely to said scraper blade of said upper scraper member, a pull blade projecting transversely and parallel to the push blade, and an attachment portion for attaching to said shaft portion of said upper scraper member, where the push blade is disposed for push scraping engagement against a work-piece and the pull blade is disposed for pull scraping engagement against the work-piece;

(c) a contour handgrip member having a bore communicating with an open end;

(d) an insert member having a bore communicating with an open end and means for preventing transverse movement of said shaft portion of said upper scraper member within said bore of said handgrip member, the insert member press-fitted within said bore of said handgrip member such that the open end extends partially out from said handgrip member;

(e) spring means located between said open end of said insert member and said one end of said head portion for absorbing the impact of the reciprocation movement of said head portion of said upper scraper member; and (f) a resilient member located between said one end of said head portion and said spring means to further absorbs said impact of said upper and lower scraper members.

15. The shock absorbing scraper in accordance with claim 14 wherein said spring means is a coil spring.

16. The shock absorbing scraper in accordance with claim 14 wherein said means for preventing transverse movement of said head portion includes a pair of opposite protruding tabs.

17. The shock absorbing scraper in accordance with claim 14 wherein said lower scraper member is made of semi-rigid plastic material.

18. The shock absorbing scraper in accordance with claim 14 wherein said handgrip member further includes a curved portion to provide a pushing angle for a user's hand.

19. A shock absorbing scraper for scraping a surface to be scraped and absorbing the impact of the scraper, comprising:

(a) an upper scraper member having a head portion and a shaft portion integrally formed with one end of the head portion, the head portion having a scraper blade on the other end, the shaft portion having means for preventing transverse movement of the head portion;

(b) a lower scraper member having a flexible front push blade extending outwardly and transversely to said scraper blade of said upper scraper member, a pull blade projecting transversely and parallel to the push blade, and an attachment portion for attaching to said shaft portion of said upper scraper member, where the push blade is disposed for push scraping engagement against a work-piece and the pull blade is disposed for pull scraping engagement against the work-piece;

(c) a contour handgrip member having a bore communicating with an open end;

(d) an insert member having a bore communicating with an open end and at least one protruding tab for preventing transverse movement of said shaft portion of said upper scraper member within said bore of said handgrip member, the insert member press-fitted within said bore of said handgrip member such that the open end extends partially out from said handgrip member; and (e) spring means located between said open end of said insert member and said one end of said head portion for absorbing the impact of the reciprocation movement of said upper scraper member.

20. The shock absorbing scraper in accordance with claim 19 wherein said spring means is a coil spring.

* * * * *